US006404312B1

(12) United States Patent
Comtois et al.

(10) Patent No.: US 6,404,312 B1
(45) **Date of Patent: *Jun. 11, 2002**

(54) DC ELECTROMAGNET

(75) Inventors: Patrick Comtois, Dijon; Alain Fraisse, Quetigny; Regis Perrocheau, Couternon; Patrick Roger, Auxonne, all of (FR)

(73) Assignee: Schneider Electric Industries SA, Rueil-Malmaison (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/544,552

(22) Filed: Apr. 6, 2000

(30) Foreign Application Priority Data

Apr. 12, 1999 (FR) ..... 99 04566

(51) Int. Cl.[7] ..... H01F 7/08

(52) U.S. Cl. ..... 335/220; 335/255; 335/257; 335/261; 335/270; 335/277; 335/279

(58) Field of Search ..... 335/229–234, 335/255, 257, 261–265, 269, 270, 271, 277, 279, 281

(56) References Cited

U.S. PATENT DOCUMENTS

| | | | | |
|---|---|---|---|---|
| 4,635,016 A | * | 1/1987 | Guery et al. | 335/230 |
| 4,855,701 A | * | 8/1989 | Yokoyama et al. | 335/230 |
| 4,910,487 A | | 3/1990 | Kleinhappl | 335/234 |

FOREIGN PATENT DOCUMENTS

| | | |
|---|---|---|
| EP | 0 174 239 | 3/1986 |
| EP | 0 380 693 | 8/1990 |
| GB | 2 216 722 | 10/1989 |

* cited by examiner

*Primary Examiner*—Ramon M. Barrera
(74) *Attorney, Agent, or Firm*—Oblon, Spivak, McClelland, Maier & Neustadt, P.C.

(57) ABSTRACT

DC electromagnet comprising a magnetic circuit equipped with a yoke and a magnetic core fixed at its ends with vanes and capable of axial displacement.

The magnetic core 21 is smooth and the vanes 22,23 are shrink fitted and fixed to the ends of the smooth core. One of the vanes 22 is fixed to the core in a reference position and is then put into contact with the associated flange 25 of yoke 14, and the other vane 23 is shrink fitted and pushed into an adjustable position determined by bringing the yoke 14 into contact with the other flange 26.

8 Claims, 3 Drawing Sheets

DC ELECTROMAGNET

BACKGROUND OF THE INVENTION

1. Field of the Invention

This invention relates to a DC electromagnet, particularly for a low voltage power switch such as a contactor, comprising a magnetic circuit equipped with a magnetic core fixed to at least one end of a vane-shaped armature with a flat polar face and equipped with a yoke having one flange with a flat polar face associated with the vane with an axial air gap.

It also relates to a simple process for manufacturing such an electromagnet.

2. Related Art

DC electromagnets, particularly as used in contactors, are made in various shapes. The magnetic circuit for this type of electromagnet is frequently used with at least one permanent magnet that polarizes the magnetic circuit. Document FR-2 586 324 describes such a magnetic circuit, the vanes being shrink fitted on the core and fixed in contact with shoulders machined on the core.

When the electromagnet comprises two pairs of polar faces, one of which is formed by the vane and the yoke and the other is formed by another vane or polar spreading of the core and by the yoke, the relative position of the,polar faces needs to be adjusted.

SUMMARY OF THE INVENTION

Another purpose of the invention is to simplify manufacture of a DC electromagnet and to adjust pairs of polar faces of such an electromagnet.

According to the invention, the core is smooth and the vane is shrink fitted and fixed on the end of the smooth core in an adjustable position determined by application on the plane polar face of the flange of the associated yoke.

Preferably, the magnetic circuit has two parallel vanes fixed to the two ends of the core, namely a first vane put in a reference position, and a second vane. The second vane is adjusted by firstly placing the first vane, that has been fixed to the core, on the polar face of the associated first flange, and then sliding the second vane on the smooth core until it reaches a stop position on the polar face of the associated second flange, and the second vane is attached to the core while in this stop position.

The two vanes can cooperate with the flanges of the magnetic circuit, the polar faces of which are oriented in the same direction, the first vane being applied in contact with the first flange on the inner side of the magnetic circuit and the second vane applied on the second flange on the outer side of the magnetic circuit.

BRIEF DESCRIPTION OF THE DRAWINGS

The following describes a non-restrictive embodiment of the invention with respect to the attached drawings.

Figure 1:
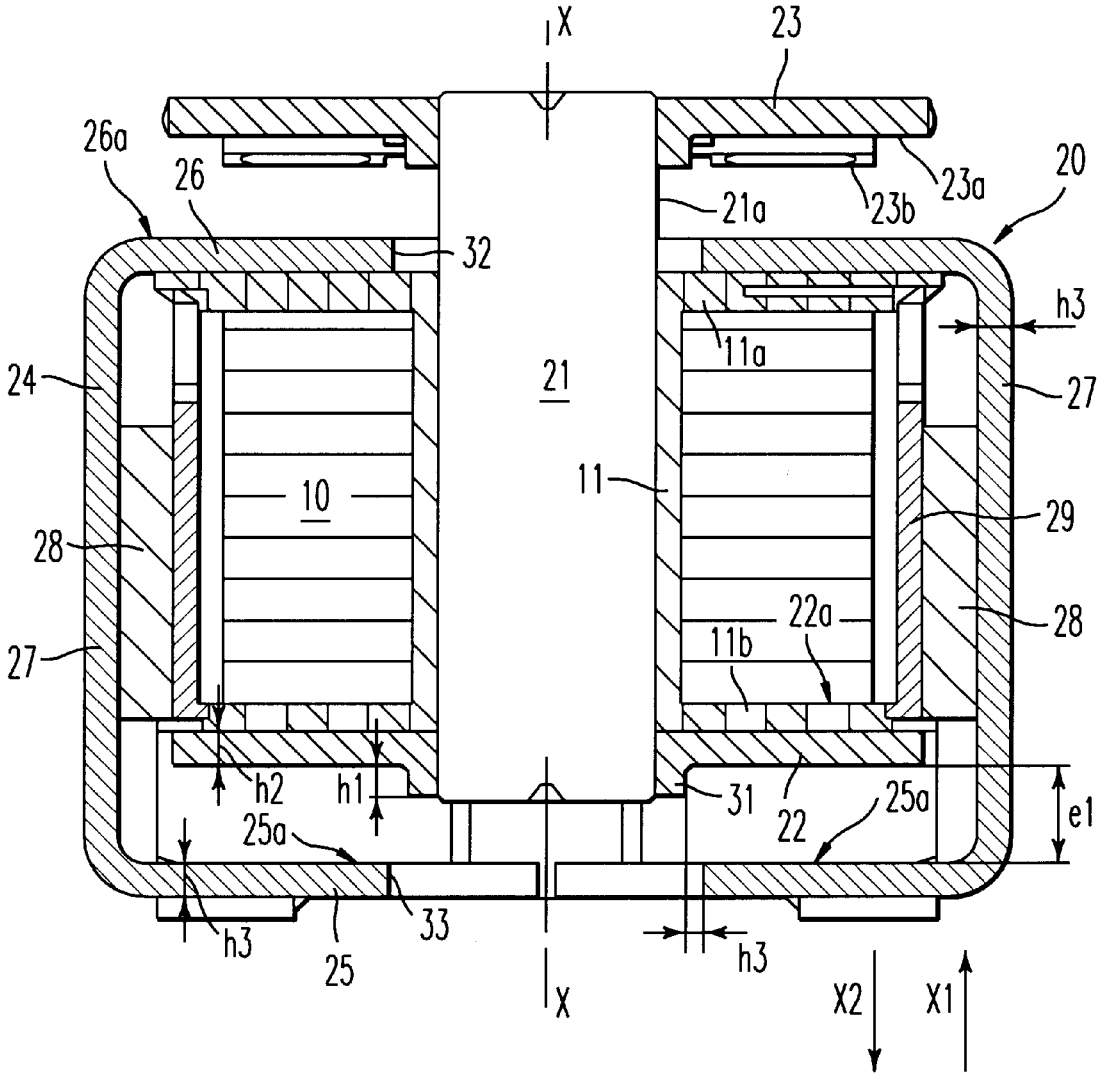
FIG. 1 represents a sectional view of an electromagnet according to the invention.

The electromagnet shown is designed to be included in a DC contactor in order to actuate contacts in response to the excitation and de-excitation of its coil 10. The coil 10 comprises a conducting winding laid out on isolating casing 11 and a magnetic circuit 20 designed to direct magnetic flux generated by a DC current passing through the winding.

The magnetic circuit 20 is made of iron or a magnetic metal and comprises a magnetic core 21 with a generally cylindrical shape along the X axis and armatures in the shape of vanes. The core 21 is provided with a smooth bearing surface 21*a* over its entire length without any discontinuity, in other words without any stop for vanes 22,23. Consequently, the core can be cut from an ordinary bar.

The vanes are plates made of a sintered magnetic material with plane polar faces 22*a*,23*a* fixed at selected locations on the two ends of the core. The polar face 23*a* of the vane 23 is fitted with an air gap part 23*b* held in contact with this flange 23*a* at and around the collar. The air gap part 23*b* is a U-shaped part, for example mounted by clamping on collar 30 or by click fitting on the vane. The air gap part 23*b* is elastic, and particularly metallic, and acts as an air gap shim and an air gap spring in order to provide assistance when the electromagnet is de-energized. Another known type of air gap device could be provided.

Figure 2:
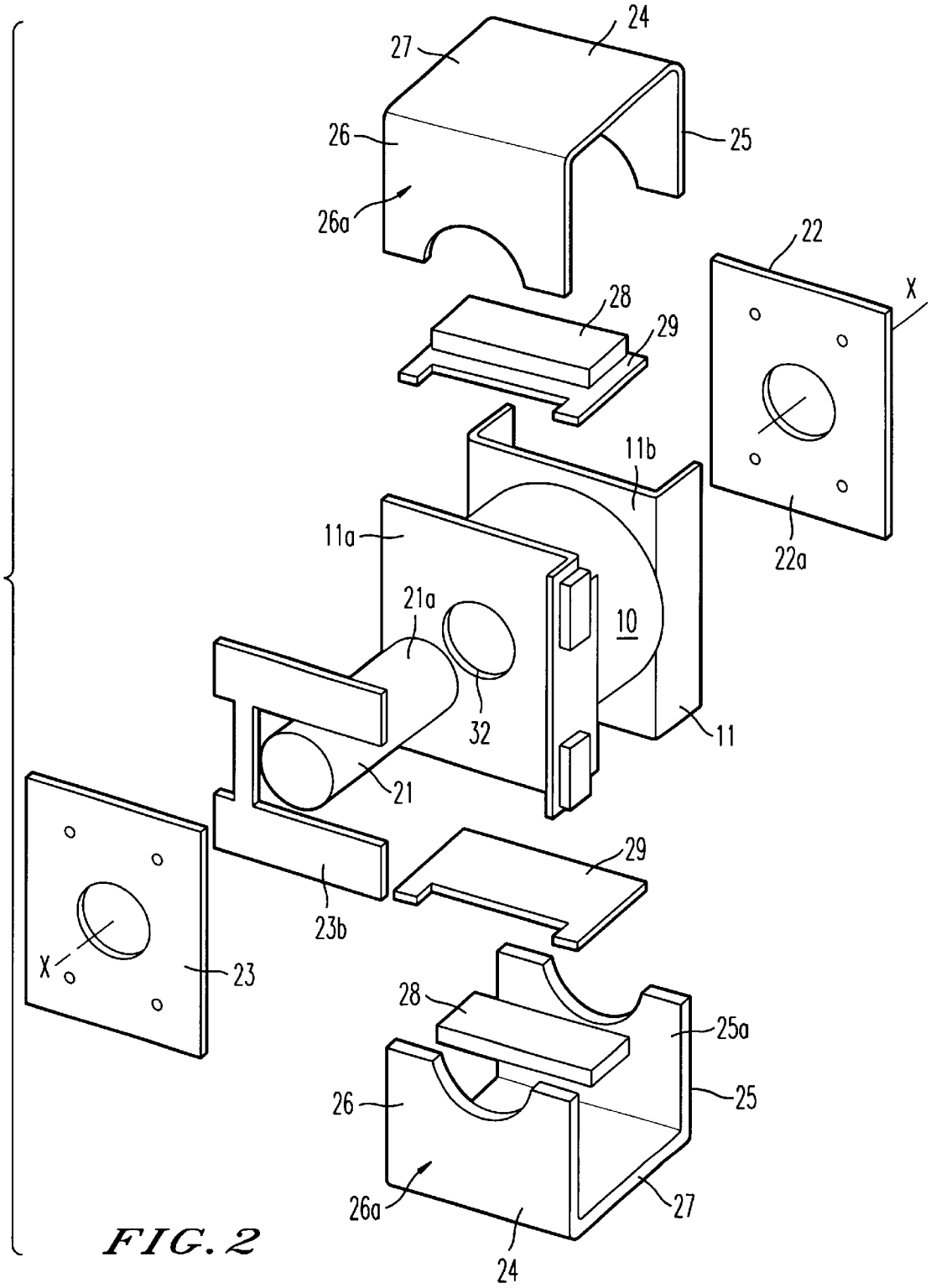
FIG. 2 is an exploded perspective view of the electromagnet.
Figure 3:
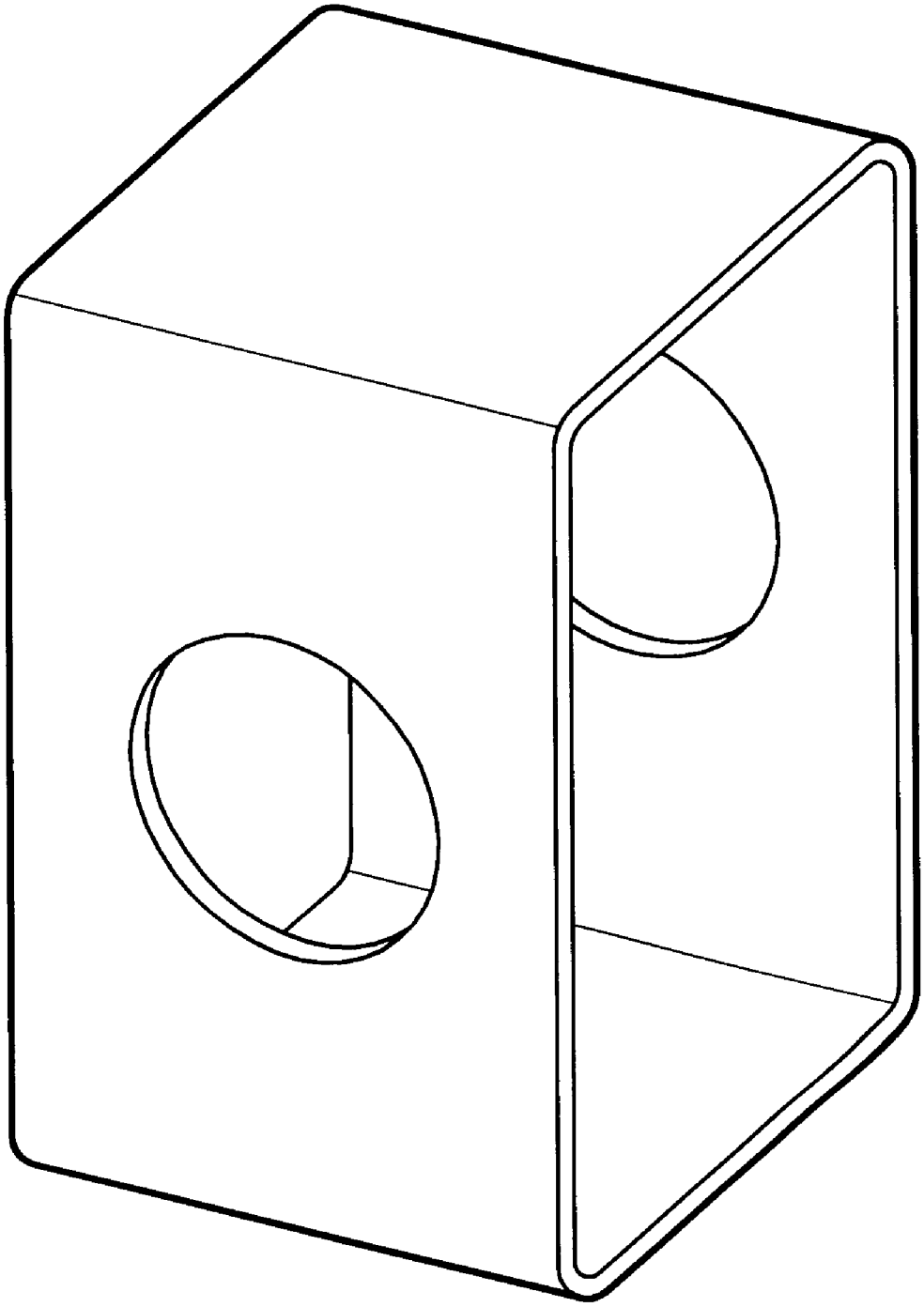
FIG. 3 is a perspective view of a unitary-construction yoke 24 that is an alternative embodiment of the two-piece yoke shown in FIG. 2.

The magnetic circuit 20 comprises a yoke 24 formed of one or two yoke parts. FIG. 2 shows a two-part embodiment of the yoke, and FIG. 3 shows a one-part (unitary) embodiment of the yoke. In the example of a two-part yoke shown in FIG. 2, the yoke 24 includes a U-stirrup 24 forming flanges 25, 26 with planar polar faces 25*a*, 26*a* associated with the polar faces 22*a*, 23*a* respectively of vanes 22, 23 with an axial air gap that can reach a maximum value of (FIG. 1).

Stirrup parts 24 are each provided with a flange 27 and each flange 27 is associated with a permanent magnet 28 that polarizes the magnetic circuit. The magnets 28 are laid out on plates 29 separating flanges 11*a*, 11*b* from the casing of coil 11. In another embodiment, there is no permanent magnet and the magnetic circuit is not polarized.

Note that vanes 22,23 cooperate with the polar faces 25*a*,26*a* of the flanges 25,26 facing in the same direction X1. Face 25*a* is facing the inside of the magnetic circuit 20 (towards the other flange 26) and face 26*a* is facing the outside of the magnetic circuit. A mobile contact holder specific to the contactor (not shown) can be assembled on a mobile part of the magnetic circuit 20, which could be the outer vane 23 or the yoke. It is understandable that in all cases, the assembly 21,22,23 and the assembly 24–27 are subject to relative movement along the X direction. In this case, parts 10,24,28,29 are fixed and the assembly 21,22,23 is mobile.

Each vane 22,23 is shrink fitted and then fixed in a predetermined position on core 21 and includes the magnetic circuit 20 associated with a flux reinforcement collar 30,31, at the side of flange 25,26. Vanes are preferably attached to the core by welding, but possibly by gluing or any other similar attachment method. The height h1 of the collar 30,31 is approximately equal to the thickness h2 of the vane 22,23 of which it forms part, and the thickness h3 of the associated flange 25,26 in the magnetic circuit. The vanes 22,23 are preferably identical, in order to simplify manufacture.

In the retracted position of the core, collars 30,31 are located adjacent to openings 32,33 of flanges 25,26 respectively, the outside cross-section of the collars being slightly less than the cross-section of the openings, in order to form a radial air gap e2.

The electromagnet is assembled as follows. The cylindrical core 21 is obtained very simply by cutting a cylindrical bar, without the need for machining in order to form a vane stop. The vane 22 is shrink fitted and fixed to the smooth core 21, for example by clamping and/or welding, to be fixed in a fixed reference position, and is then in close contact with the polar face 25*a* of the first flange 25. The vane 23, previously shrink fitted on core 21, is then pushed along the X2 direction opposite to X1 to be adjusted on the core by sliding until the air gap part 23*b* comes into contact with the polar face 26*a* of the second flange 26, and is then welded to the core. The vanes 22,23 are preferably fixed by laser welding.

What is claimed is:

1. An electromagnet, comprising:

a) a yoke of unitary construction, including:

1) a first flange with a first flange surface that faces a first direction, and 2) a second flange with a second flange surface that faces the first direction; and b) an armature including:

1) a magnetic core that has a smooth outer surface, a first end and a second end;

2) a first vane that is shrink fit and fixed on the first end of the magnetic core and placed in a reference position with respect to the first flange surface, and 3) a second vane that is shrink fit and fixed on the second end of the magnetic core, and that is adjusted to a stop position that is determined by moving the second vane on the magnetic core toward the second flange surface until the second vane stops.

2. the electromagnet of claim 1, wherein the first and second vanes are fixed to the core by a method including:

placing the first vane against the first flange surface;

sliding the second vane on the core until the second vane reaches the stop position determined by the second flange surface; and shrink fitting and fixing the second vane to the core in the stop position.

3. The electromagnet of claim 2, wherein:

the first flange surface is an interior surface of the yoke; and the second flange surface is an exterior surface of the yoke.

4. The electromagnet of claim 1, further comprising:

an elastic air gap part, oriented between the second vane and the second flange surface, configured to form an air gap shim and function as an air gap spring.

5. An electromagnet, comprising:

a) a yoke including portions formed in the shape of a continuous "U" and including:

1) a first flange with a first unitary planar polar flange surface that faces a first direction, and 2) a second flange with a second unitary planar polar flange surface that faces the first direction; and b) an armature including:

1) a magnetic core that has a smooth outer surface, a first end and a second end;

2) a first vane that is shrink fit and fixed on the first end of the magnetic core and placed in a reference position with respect to the first flange surface, and 3) a second vane that is shrink fit and fixed on the second end of the magnetic core, and that is adjusted to a stop position that is determined by moving the second vane on the magnetic core toward the second flange surface until the second vane stops.

6. The electromagnet of claim 5, wherein the first and second vanes are fixed to the core by a method including:

placing the first vane against the first flange surface;

sliding the second vane on the core until the second vane reaches the stop position determined by the second flange surface; and shrink fitting and fixing the second vane to the core in the stop position.

7. The electromagnet of claim 6, wherein:

the first flange surface is an interior surface of the yoke; and the second flange surface is an exterior surface of the yoke.

8. The electromagnet of claim 5, further comprising:

an elastic air gap part, oriented between the second vane and the second flange surface, configured to form an air gap shim and function as an air gap spring.

* * * * *